US006417758B1

(12) United States Patent
Russell et al.

(10) Patent No.: US 6,417,758 B1
(45) Date of Patent: Jul. 9, 2002

(54) THERMOSTAT WITH SPRING CLIP FOR ACCOMMODATING OUT-OF-ROUND TUBING

(75) Inventors: Larry Russell, Lexington; Tung-Sheng Yang; Frank Winter, both of Mansfield; Mark Rader, Ashland, all of OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 09/478,160

(22) Filed: Jan. 5, 2000

Related U.S. Application Data

(63) Continuation-in-part of application No. 09/227,598, filed on Jan. 8, 1999.

(51) Int. Cl.[7] ..... H01H 37/04; F28F 9/007; F28F 9/013

(52) U.S. Cl. ..... 337/380; 337/417; 165/80.2; 165/80.1; 24/457; 248/65; 248/74.3

(58) Field of Search ..... 337/380, 34, 112, 337/121, 327, 398, 414, 417; 165/80.1–80.5; 24/572, 455–457; 248/65, 74.3, 74.4, 75

(56) References Cited

U.S. PATENT DOCUMENTS 2,191,782 A * 2/1940 Valane ..... 248/229
2,273,381 A * 2/1942 Shaw ..... 200/139
2,369,364 A * 2/1945 Mayer ..... 206/19.5
2,907,851 A * 10/1959 Moorhead et al. ..... 200/138
2,972,461 A 2/1961 Balbach et al.
2,996,275 A 8/1961 Holton
3,015,869 A 1/1962 Rapata
3,515,363 A 6/1970 Fisher
3,901,480 A 8/1975 Basile et al.
4,297,668 A * 10/1981 Place ..... 337/365
4,564,163 A 1/1986 Barnett
4,609,171 A 9/1986 Matsui
4,623,102 A 11/1986 Hough, Jr.
4,626,821 A 12/1986 Versaw
5,108,055 A 4/1992 Kreinberg et al.
5,164,545 A 11/1992 Kreinberg et al.
5,307,543 A * 5/1994 Krillenberger ..... 24/543
5,639,049 A 6/1997 Jennings et al.
5,870,014 A * 2/1999 Nield, Jr. et al. ..... 337/362

FOREIGN PATENT DOCUMENTS

DE 3415294 A1 * 10/1985 ..... 248/74.5
GB 2047324 A * 11/1980

* cited by examiner

*Primary Examiner*—Anatoly Vortman
(74) *Attorney, Agent, or Firm*—Harness, Dickey & Pierce, P.L.C.

(57) ABSTRACT

A spring clip is attached to a thermostat bottom wall for attaching the thermostat to tubing in heat exchange relationship. The spring clip has an opening that faces transversely of the thermostat longitudinal axis so that installation forces act in a direction that is more parallel to the bottom wall to avoid denting of the bottom wall. The spring clip has a flat mounting base attached to the thermostat bottom wall to spread forces over a large area of the bottom wall and to reinforce the bottom wall against deformation.

23 Claims, 5 Drawing Sheets

THERMOSTAT WITH SPRING CLIP FOR ACCOMMODATING OUT-OF-ROUND TUBING

CROSS-REFERENCE TO RELATED APPLICATION

This application is a continuation-in-part of U.S. patent application Ser. No. 09/227,598 filed Jan. 8, 1999. The entire disclosure of this prior application is considered part of the disclosure of this application, and is hereby incorporated by reference.

BACKGROUND OF THE INVENTION

1. Technical Field

This application relates to the art of thermostat mounting clips and, more particularly, to spring clips for attaching thermostats to tubing in heat exchange relationship therewith. The invention is particularly applicable for use with thermostats that have a bimetal disc within a thermostat cup and will be described with particular reference thereto. However, it will be appreciated that the invention has broader aspects and the spring clip can be used for other purposes as well as with other types of thermostats.

2. Discussion

In a known arrangement for attaching thermostats to tubing, a generally U-shaped spring clip is welded to the bottom wall of the thermostat cup. The generally U-shaped clip makes line contact with the thermostat cup bottom wall, and is positioned so that insertion forces during attachment of the clip to the tubing act perpendicular to the thermostat cup bottom wall. These forces tend to permanently deform the thermostat cup bottom wall and this may cause improper operation of the thermostat. In addition, accidental bumping of the clip or dropping the thermostat on the clip can permanently distort the thermostat cup bottom wall in a manner that interferes with proper thermostat operation.

A prior art thermostat and clip arrangement of the type described is illustrated in FIG. 7 where a generally cylindrical thermostat cup 2 has a generally U-shaped spring clip 3 welded to its flat bottom wall 4. Clip 3 makes little more than line contact with bottom wall 4 as generally indicated at 5. The spaced-apart end portions of the arms of clip 3 define an entrance opening 6 that is centered on thermostat longitudinal axis 7. Entrance opening 6 opens outwardly in a direction parallel to axis 7 and perpendicular to thermostat bottom wall 4. Therefore, installation of clip 3 on tubing results in forces being applied to thermostat cup bottom wall 4 in a direction perpendicular thereto. Because clip 3 is welded to bottom wall 4 along a small area, these forces are concentrated and may permanently deform bottom wall 4.

It would be desirable to have an arrangement that minimizes possible damage to the bottom wall of the thermostat cup during attachment of the thermostat to tubing and to otherwise minimize possible deformation of the bottom wall by forces applied thereto through the mounting clip. Additionally, it is well known that tubing manufactured for use in, for example, the refrigeration and HVAC industries is not subject to exacting tolerances for geometric dimensions, including roundness. Furthermore, it is often the case that thermostats, like the one disclosed here, are employed in situations where they are clipped to tubing that is not round, such as when the tubing is bent at an elbow or "kinked" such that the cross-sectional configuration of the tubing is other than substantially circular. Consequently, the need has arisen for a thermostat spring clip that can attach to both tubing that exhibits a substantially circular cross-section and tubing that exhibits a non-circular or "out-of-round" cross-section while still maintaining a low insertion force, high clamping force, and still maintaining good thermal response in the thermostat.

SUMMARY OF THE INVENTION

A substantially flat mounting base on a spring clip is attached to a substantially flat bottom wall of a thermostat disc cup. The substantially flat mounting base occupies a large amount of the bottom wall area to minimize the possibility of the bottom wall being deformed by forces applied to the clip.

In a preferred arrangement, the spring clip has an entrance opening that opens in a direction transversely of the longitudinal axis of the thermostat cup. Therefore, forces applied to the clip during the attachment of same to tubing act generally parallel to the bottom wall of the thermostat cup to further minimize the possibility of bottom wall deformation by installation forces.

The spring clip has a spring arm integral with the mounting base and is positioned so that the tubing is received between the mounting base and the spring arm. The spring arm has a tubing receiving portion therein to provide high resistance against displacement of the tubing from the spring clip. The tubing receiving portion may be curved on the radius of a circle that generally corresponds to the external curvature of tubing that is received within the spring clip. In an alternative arrangement, the tubing receiving portion comprises a generally abrupt arcuate portion extending through an angle of approximately 90° and two adjacent non-arcuate portions adjoining either side of the arcuate portion. The resulting tubing receiving portion in conjunction with the mounting base contains the tubing securely at three points about the circumference of the tubing.

It is a principal object of the present invention to provide an improved spring clip for attaching a thermostat cup to tubing.

It is a further object of the invention to provide an improved thermostat clip that improves the thermal response of the thermostat and that is easier to weld to the bottom wall of a thermostat disc cup.

It is another object of the invention to provide an improved thermostat disc cup and spring clip assembly that facilitates attachment of the thermostat cup to tubing while providing high resistance to displacement of the thermostat disc cup from its attachment to tubing.

It is an additional object of the invention to provide an improved arrangement for attaching a spring clip to the bottom wall of a thermostat disc cup in a manner that minimizes the possibility that the bottom wall will be deformed by forces applied to the spring clip.

It is a further object of the invention to provide an improved thermostat disc cup and spring clip assembly that requires relatively low installation force while providing relatively high retention force.

It is yet another object of the present invention to provide an improved thermostat disc cup and spring clip assembly that can be used with tubing having both substantially circular and non-circular cross-sections.

Compared to the previous design of FIG. 7, the design of the present application requires an insertion force that is only approximately 29% of the insertion force of the previous design. At the same time, the design of the present application provides an average increase of approximately 10% in retention force compared to the previous design of FIG. 7. The large surface area of the mounting base of the clip and the large surface area of engagement between such base and the bottom wall of the thermostat disc cup provides a 22% improvement in thermal response compared to the design of FIG. 7. Compared to the design of FIG. 7, the design of this application provides about 60 times more dent resistance for the cup bottom wall in a 20 pound deformation test. For drop impact testing at a distance of six feet, the clip of the present application has about 24 times more dent resistance than the arrangement of FIG. 7.

BRIEF DESCRIPTION OF THE DRAWINGS

The various advantages of the present invention will become apparent to one skilled in the art upon reading the following specification, in which.

DESCRIPTION OF THE PREFERRED EMBODIMENT

It should be understood from the outset that while the following discussion illustrates particular embodiments of the present invention, these embodiments merely represent a best mode of currently practicing the invention and other modifications may be made to the particular embodiments without departing from the spirit and scope of the invention.

Figure 1:
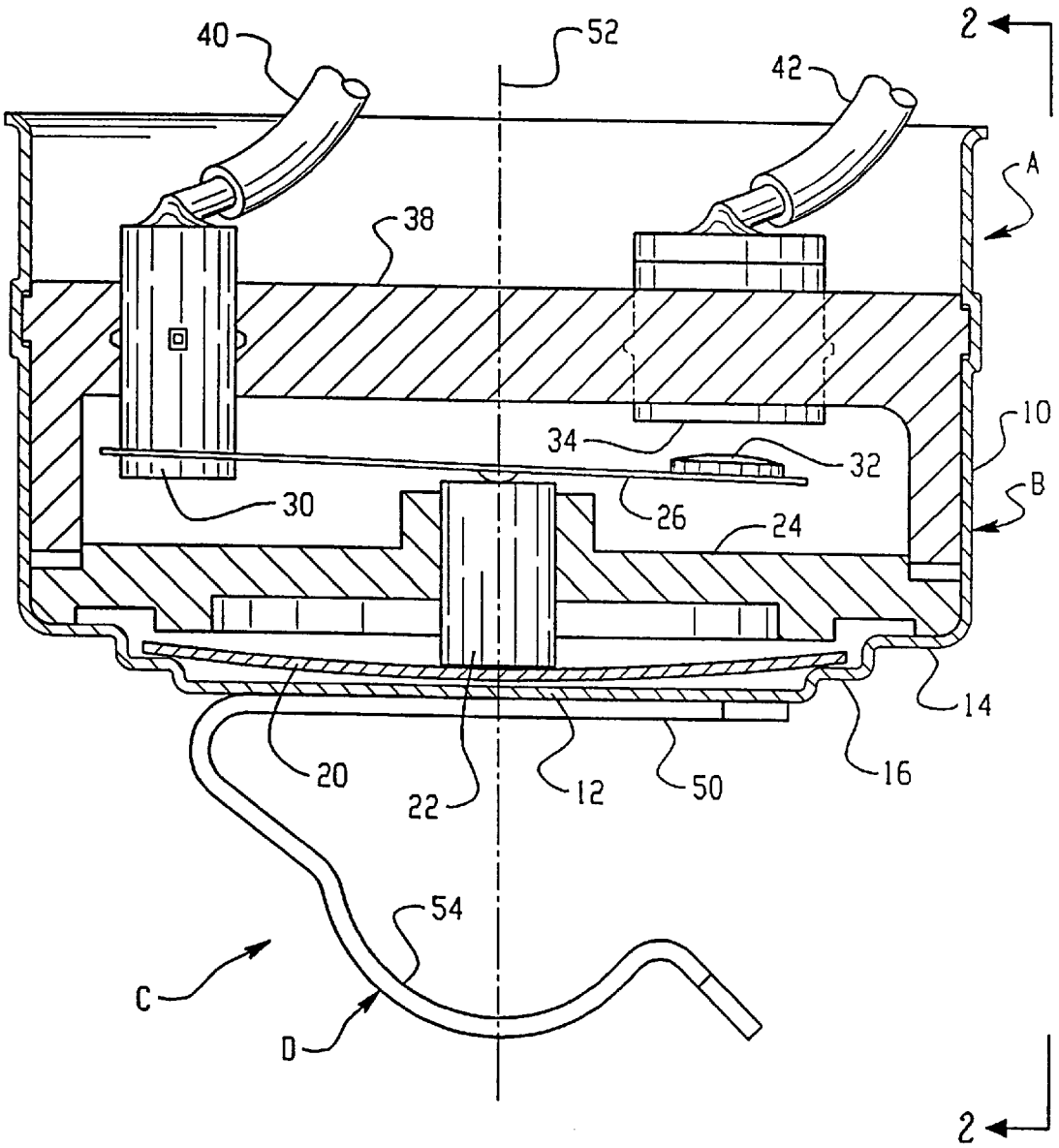
FIG. 1 is a cross-sectional elevational view of a thermostat disc cup having a first embodiment of the improved spring clip of the present invention attached to a bottom wall thereof.

Referring now to the drawings, wherein the illustrations are for purposes of showing the preferred embodiment of the present invention and not for purposes of limiting same, FIG. 1 shows a thermostat A having a metal disc cup B with a generally cylindrical peripheral wall 10 and a substantially flat circular bottom wall 12 with a substantially flat circular external surface.

The bottom portion of disc cup B is stepped as generally indicated at 14, 16 to provide a circumferential shoulder on which the peripheral portion of a bimetal disc 20 rests in spaced relationship to bottom wall 12. A cylindrical plunger 22 is slideably received in a cylindrical hole in a plastic member 24 for cooperation with bimetal disc 20 and with a switch blade 26 that is attached at one end to a post 30 and carries a contact 32 adjacent its other end that cooperates with a fixed contact 34. Post 30 and fixed contact 32 are attached to a plastic support member 38, and wires 40, 42 are attached to post 30 and to the terminal that provides fixed contact 34. The cavity within thermostat cup B above plastic support member 38 may be filled with epoxy or another suitable potting compound which then surrounds wires 40, 42 and encapsulates the upper end portions of post 30 and the terminal that is associated with fixed contact 34.

Bimetal disc 20 normally is downwardly curved toward bottom wall 12 as shown in FIG. 1 and heat is transferred to bimetal disc 20 through bottom wall 12. At a predetermined temperature, bimetal disc 20 will snap to an opposite upwardly curved position and move plunger 22 upwardly to close contacts 32, 34. When bimetal disc 20 cools, it will snap back to the position shown in FIG. 1 and contacts 32, 34 will separate.

Figure 2:
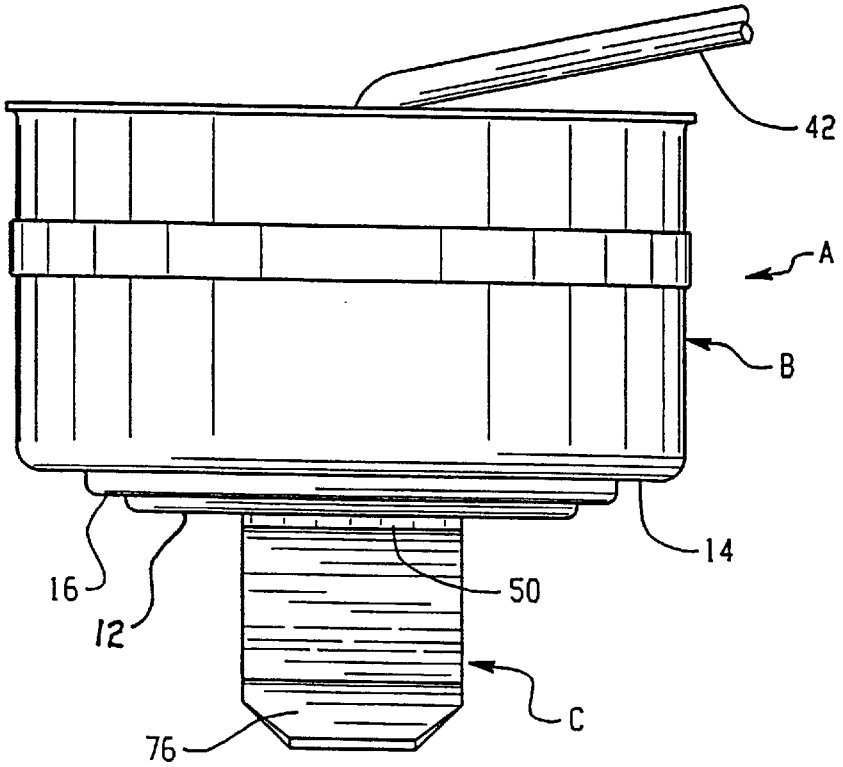
FIG. 2 is a side elevational view taken generally on line 2—2 of FIG. 1.
Figure 3:
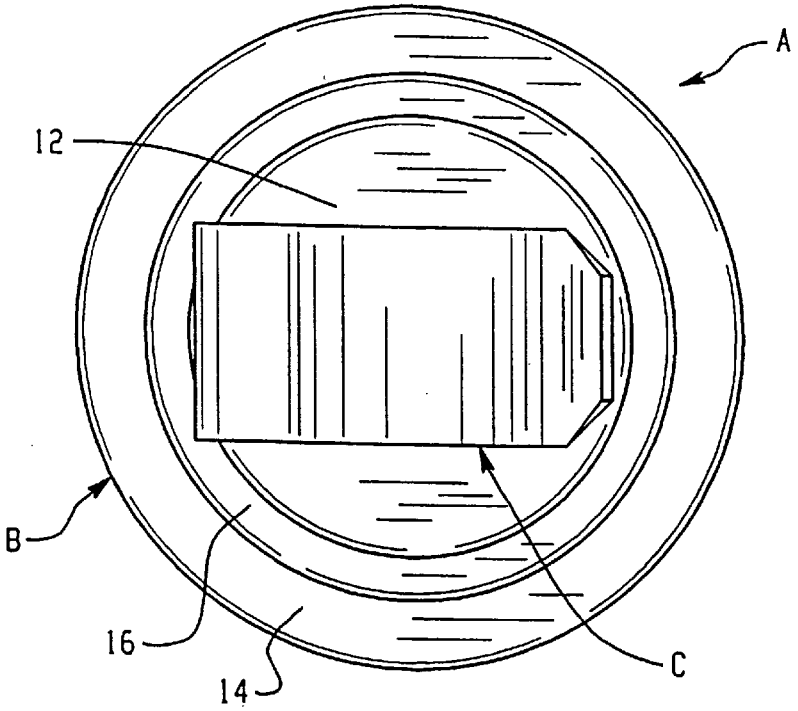
FIG. 3 is a bottom plan view of the thermostat and clip assembly of FIG. 1.

Referring to FIGS. 1–3, a spring clip C of stainless steel or other suitable material has a substantially flat mounting base 50 welded or otherwise suitably attached to bottom wall 12 of thermostat disc cup B. Spring clip C includes a spring arm D that extends back along mounting base 50 in a spaced relationship thereto to provide an entrance opening that opens transversely of thermostat longitudinal axis 52. Spring arm D has a tubing receiving portion 54 therein for inhibiting displacement of cylindrical tubing from its position between spring arm D and mounting base 50. Mounting base 50 preferably is centered on bottom wall 12. That is, the center of the area of mounting base 50 is close to or coincides with disc cup longitudinal axis 52 which is also the center of bottom wall 12.

A thermostat and spring clip assembly is attached to cylindrical tubing by aligning the entrance opening of the spring clip with the tubing. Lateral force then is applied to the thermostat and spring clip to bias spring arm D resiliently away from mounting base 50 for allowing movement of the tubing to a position with portion 54. Spring arm D then closes tightly on the tubing and also urges mounting base 50 into firm engagement with the tubing. A longitudinal axis of the tubing extends perpendicular to thermostat longitudinal axis 52, and the tubing longitudinal axis either intersects thermostat longitudinal axis 52 or is very close to intersection therewith.

Figure 6:
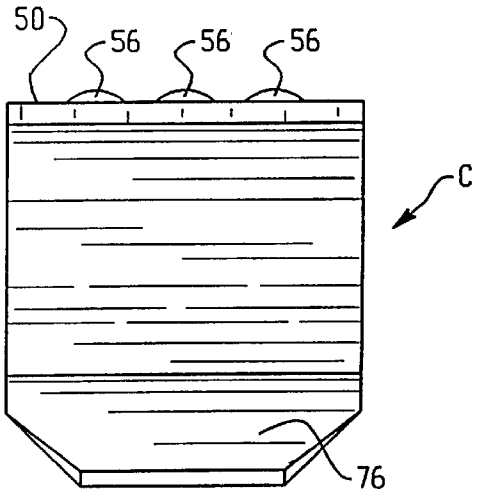
FIG. 6 is an end elevational view of the improved spring clip of FIG. 4.
Figure 5:
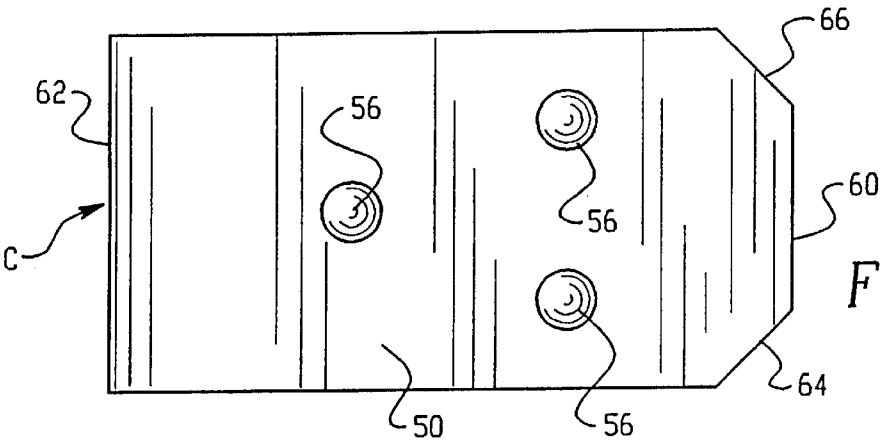
FIG. 5 is a top plan view of the improved spring clip of FIG. 4.
Figure 4:
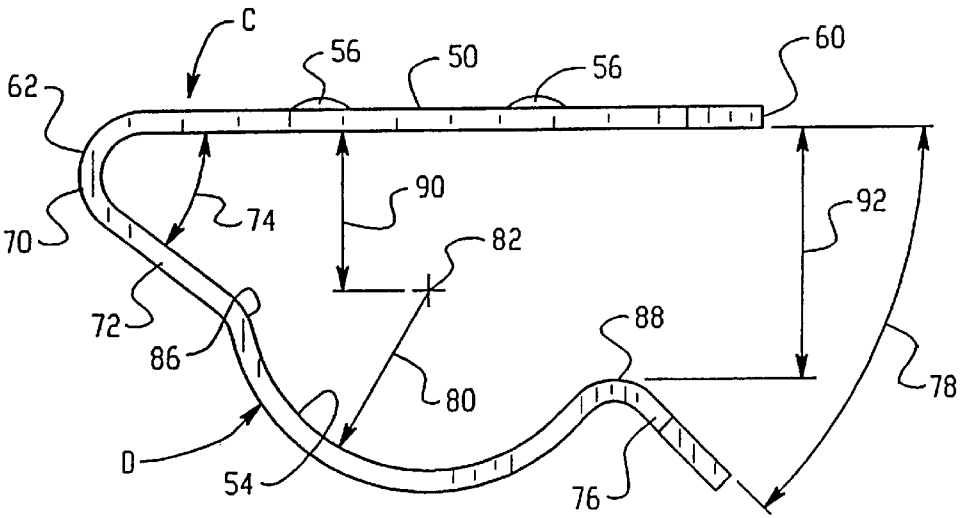
FIG. 4 is a side elevational view of a first embodiment of the improved spring clip of the present invention.

With reference to FIGS. 4–6, substantially flat mounting base 50 has a plurality of spaced-apart raised bumps 56 on the surface thereof that faces toward thermostat bottom wall 12 to facilitate welding thereof to the bottom wall. Mounting base 50 is substantially rectangular and has first and second opposite ends 60, 62. The corners adjacent first end 60 are removed to provide 45° peripheral surface portions 64, 66. This allows end 60 to be positioned closer to the circular periphery of bottom wall 12 without having the corners extend radially outwardly beyond the circular outer periphery of bottom wall 12. Obviously, the end of the mounting base could be curved or otherwise shaped to accomplish the same purpose.

Clip C is reversely bent adjacent second end 62 of mounting base 50 as generally indicated at 70 to form spring arm D. Spring arm D has a straight portion 72 adjacent mounting base 50 that makes an angle 74 with mounting base 50 that is between 25–45°. Arm D has a straight terminal end portion 76 that is inclined at an included angle 78 with mounting base 50 that is between 35–55°. Angle 74 may vary depending on the size of the tubing with which the clip will be used. For example, for a clip to be used with a ⅜ inch diameter tubing, angle 74 has been selected to be approximately 38.4°. For a clip to be used with a 5/16 inch diameter tubing, angle 74 has been selected to be approximately 30.5°. For all clip sizes, angle 78 has been selected to be approximately 45°.

Tubing receiving portion 54 preferably is curved on a radius about a center 82 that is located between mounting base 50 and arm D. Radius 80 preferably is slightly larger than the radius of the cylindrical outer surface of the tubing that is received within the clip by at least several thousandths of an inch. For example, when the clip is for use with tubing having an external diameter of 3/8 inch, radius 80 would be slightly larger than 3/16 inch. Where the clip is for use with tubing having an external diameter of 5/16 inch, radius 80 would be slightly larger than 5/32 inch. Center 82 is located within 20% of the midpoint of the distance between first and second ends 60, 62 of mounting base 50, more preferably within 10% thereof, and most preferably within 5% thereof.

Tubing receiving portion 54 has a first intersection 86 with arm straight portion 72 and a second intersection 88 with spring arm end portion 76. First intersection 86 is located a distance 90 from the inner surface of mounting base 50 and second intersection 88 is located a distance 92 from the inner surface of mounting base 50. Dimension 90 also corresponds to the distance from the surface of clip mounting portion 50 to center 82 of radius of curvature 80 for tubing receiving portion 54. The entrance opening 92 to the interior of spring clip C is defined between the interior surface of mounting base 50 and intersection 88. Downwardly inclined spring arm end portion 76 provides a cam surface that acts against the curved surface of the tubing to cam spring arm D away from mounting base 50 so that the spring clip can be snapped over the tubing. Curved tubing receiving portion 54 extends over an arc of approximately 150° between intersections 86 and 88. This arc preferably does not vary from that most preferred angle by more than ±10° and more preferably by not more than ±5°.

Distances 90 and 92 vary with the size of the spring clip for use with tubing of different diameters. In a clip to be used with tubing having an external diameter of 3/8 inch, dimension 90 is approximately 0.150 inch and dimension 92 is approximately 0.244 inch. In a clip to be used with tubing having an external diameter of 5/16 inch, dimension 90 is approximately 0.125 inch and dimension 92 is approximately 0.203 inch. Thus, entrance opening dimension 92 is approximately 65% of the external diameter of tubing with which the clip is to be used. This entrance opening dimension could be between 60–70% of the tubing external diameter or about 0.160–0.260 inch. Distance 90 from mounting base 50 to center 82 is approximately 40% of the external diameter of the tubing with which the clip is to be used. This dimension could be between 35–45% of the tubing external diameter or about 0.115–0.160 inch. However, dimensions 90 and 92 preferably do not vary by more than 10% and most preferably by not more than 5% from the dimensions that correspond to 40% and 65% of the external diameter of the tubing with which the clip is to be used.

Clip entrance opening 92 is located closely adjacent the outer periphery of bottom wall 12 and is spaced slightly inwardly of such outer periphery. Entrance opening 92 is located much closer to the outer periphery of bottom wall 12 than to disc cup longitudinal axis 52. Entrance opening 92 is also spaced from first end 60 of mounting base 50 in a direction toward second end 62.

By way of example, disc cup circular bottom wall 12 has a diameter of 0.6875 inch and an area of 0.371 inch$^2$. Clip mounting base 50 has a length of 0.632 inch that is approximately 92% of the bottom wall diameter and a width of 0.330 inch that is approximately 48% of the cup diameter. The area of the mounting base 50 that engages bottom wall 12 is approximately 56% of the area of bottom wall 12. Preferably, mounting base 50 engages bottom wall 12 over an area that is at least 40% of the bottom wall area and the length of the mounting base is at least 70% of the diameter of the bottom wall. The width of the mounting base is at least 30% of the diameter of the bottom wall.

Figure 7:
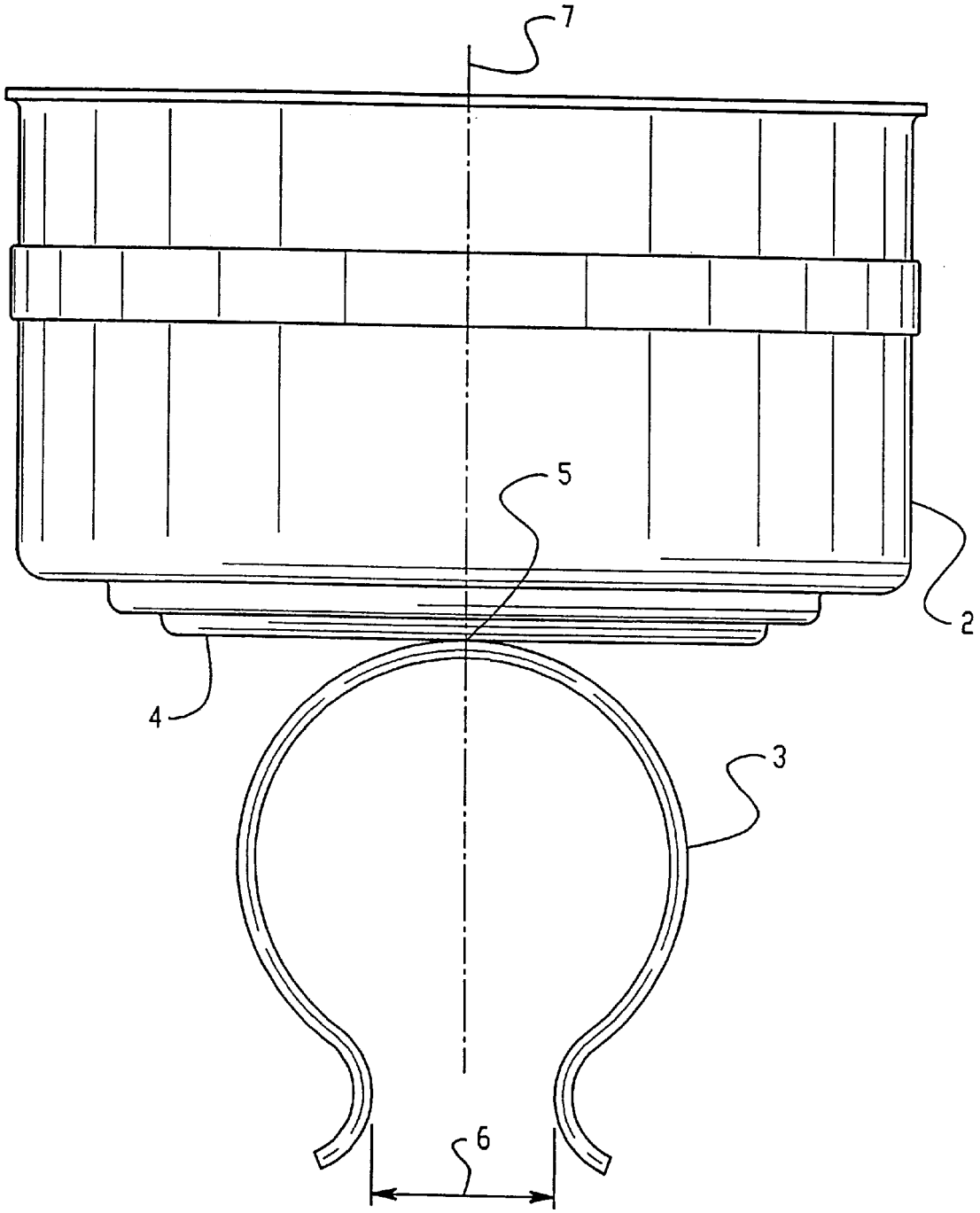
Fig. 7 (PRIOR ART)
FIG. 7 is a side elevational view of a prior art thermostat disc cup and spring clip assembly.

The following is a comparison of the performance of the clip of the present application compared to the clip of FIG. 7. Measurements were made of the deformation of bottom 12 in response to various loads applied to the spring clip acting in a direction toward bottom wall 12 parallel to the longitudinal axis of the thermostat disc cup. Retention force is measured by pulling on the thermostat in a direction parallel to its longitudinal axis until the clip releases from the tubing.

| Clip | FIG. 7 | FIGS. 1–6 | FIGS. 1–6 |
|---|---|---|---|
| Tubing size (inch) | 3/8 | 3/8 | 1/4 |
| Number of samples tested | 13 | 12 | 12 |
| Deformation (inch) (small is better) | | | |
| 20 lbs. | 0.0178 | 0.0003 | 0.0000 |
| 45 lbs. | 0.0350 | 0.0012 | 0.0007 |
| 60 lbs. | 0.0469 | 0.0017 | 0.0001 |
| Insertion Force (lbs.) (small is better) | | | |
| Mean | 14.0 | 4.1 | 4.7 |
| Max. | 16.3 | 4.6 | 5.7 |
| Min. | 12.9 | 3.4 | 3.9 |
| Retention Force (lbs.) (large is better) | | | |
| Mean | 6.8 | 7.5 | 11.0 |
| Max. | 7.4 | 8.6 | 12.8 |
| Min. | 6.3 | 6.6 | 8.9 |

From the above tests of clips for 3/8 inch tubing, it is seen that the mean insertion force of 4.1 for the new design is a reduction of approximately 71% from the mean insertion force of 14.0 for the design of FIG. 7. The mean retention force of 7.5 for the design of the present application is an increase of approximately 10% over the mean insertion force of 6.8 for the design of FIG. 7. The large surface area of engagement between the clip mounting base and the disc cup bottom wall also improves heat transfer for better thermal response. The large engagement area also reinforces the disc cup bottom wall against deformation and spreads forces out over a greater area of the cup bottom wall.

Figure 8:
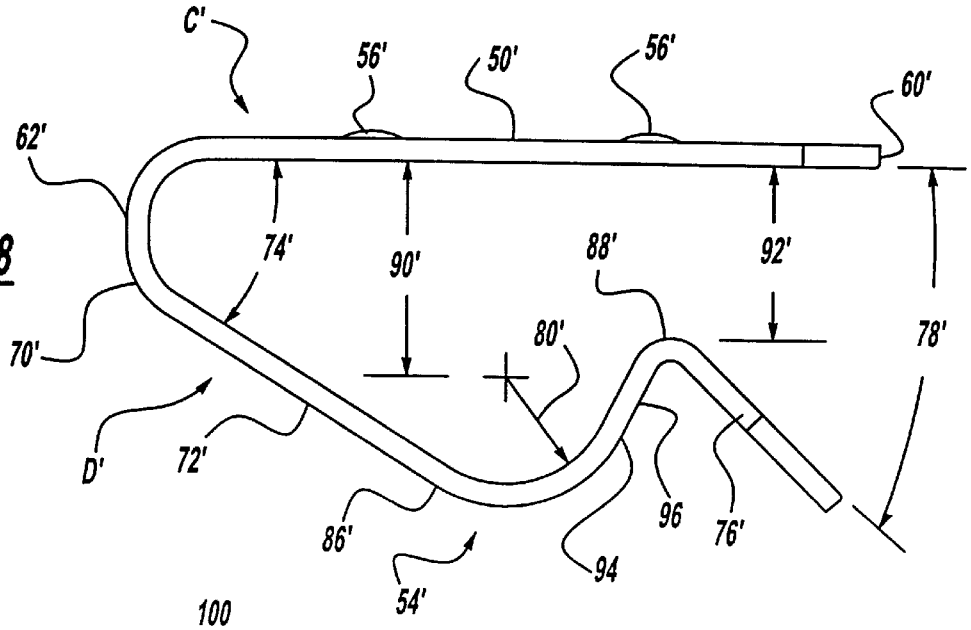
FIG. 8 is a side elevational view of an alternate embodiment of the improved spring clip of the present invention.

An alternate embodiment of the spring clip of the present invention is disclosed and shown at FIG. 8. Spring clip C' is suitable to accommodate and attach to tubing that is either cylindrical or non-cylindrical, the latter including tubing having cross-sections which exhibit out-of-round conditions.

The spring clip C' possesses the same general configuration of the spring clip C as described above, such as a flat mounting base 50' and a spring arm D' that extends back along the mounting base 50' in a spaced relationship to provide an entrance opening that opens transversely of the thermostat longitudinal axis 52. Like features of the spring clips C and C' are similarly designated with like numerals. However, spring clip C' includes a tubing receiving portion 54' that varies from the spring clip C to enable spring clip C' to accommodate tubing that are not round.

Tubing receiving portion 54' includes a radius 80' which begins at a first tangent location 86' with arm D' straight portion 72' and terminates a second tangent location 94 with a second arm D' straight portion 96. The radius 80' extends over an arc of approximately slightly greater than 90° between locations. 86' and 94. This arc preferably does not vary from 90° by more than +10°/−5°. More preferably, this arc is not less than 90°. Second straight portion 96 extends to intersection 88' which intersects w/downwardly extending spring arm end portion 76'.

Dimension 90' locating the centerline of radius 80' is greater than 70% of the outer diameter of the tubing with which the clip is to be used. More preferably, this dimension is between 85%–95% of the tubing outer diameter.

Dimension 92' is greater than 45% of the tubing outer diameter, and preferably between 45% and 65%.

Figure 9:
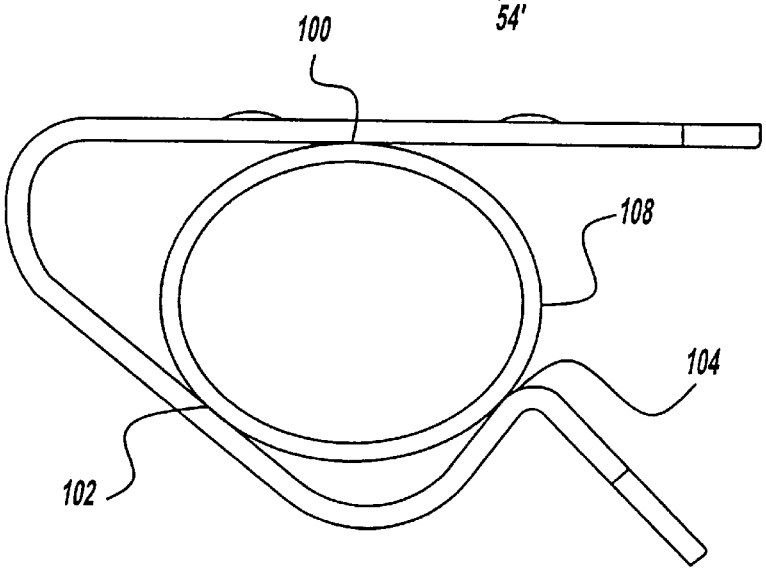
FIG. 9 is a side elevational view of the improved spring clip of FIG. 8 and showing the spring clip engaging tubing having a cross-section exhibiting an "out-of-round" condition.
Figure 10:
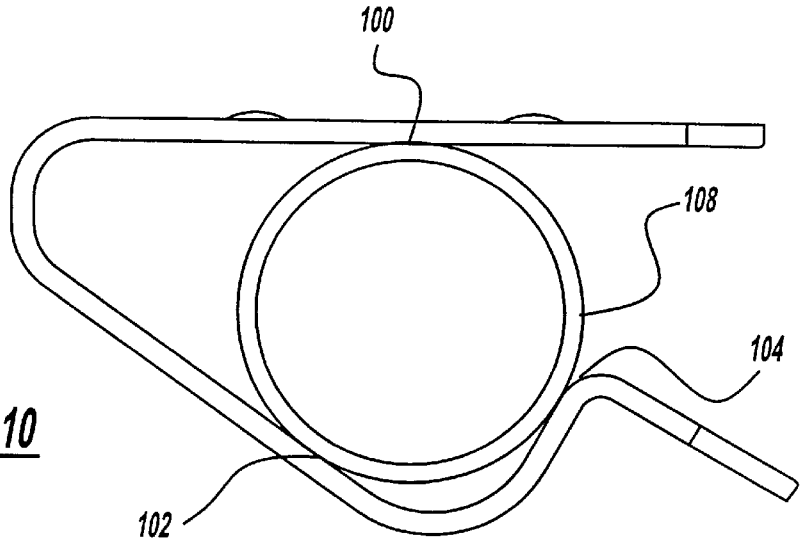
FIG. 10 is a side elevational view of the improved spring clip of FIG. 8 and showing the spring clip engaging tubing having a cross-section that is substantially circular.

Spring clip C' is designed to engage the tubing at least three locations, 100, 102, 104, on the exterior surface of the tubing. As shown in FIGS. 9 and 10, spring clip C' is thus versatile enough to accommodate and clip to tubing 106 having a circular cross-section and tubing 108 having a non-circular or "out-of-round" cross-section.

Although specific mention has been made of clips for use with tubing having an external diameter of ¼, 5/16 and ⅜ inch, it will be recognized that the clip of the present application can be used with tubing having an external diameter smaller than ¼ inch and an external diameter larger than ⅜ inch, such as up to at least ⅞ inch. Although other sizes are possible for other purposes, the clip of the present application for use on thermostats will generally be configures for use with tubing having an external diameter between ⅛–1 inch. For clips to be used with tubing having an external diameter of 5/16 or ⅜ inch, specific examples of clip dimensions have been given simply by way of illustration. It will be recognized that the example dimensions may vary for those specific sizes and that the dimensions will vary for clips to be used with tubing having other external diameters.

For clips to be used with tubing having an external diameter of ¼ and ⅜ inch, specific examples have been given of the deformation of a disc cup bottom resulting from different loads on the clip, along with examples of the tubing insertion and retention forces. It will be recognized that the clip of the present application is not limited to those ranges of disc cup bottom wall deformations, tubing insertion forces and tubing retention forces that are given by way of example. The clip of the present application has many advantages and uses for requirements that are below or above those that are given as examples. It will further be recognized that the ranges of disc cup bottom wall deformation, tubing insertion forces and tubing retention forces may vary significantly for clips to be used with tubing having other external diameters.

Although the invention has been shown and described with respect to a preferred embodiment, it is obvious that equivalent alterations and modifications will occur to others skilled in the art of the reading and understanding of this specification. The present invention includes all such equivalent alterations and modifications, and is limited only by the scope of the claims.

Various other advantages and modifications will become apparent to one skilled in the art after having the benefit of studying the teachings of the specification, the drawings, and the following claims.

What is claimed is:

1. A thermostat comprising:

a thermostat cup in a heat exchange relationship with a mounting clip;

said thermostat cup comprising a longitudinal axis and a substantially flat external bottom surface;

said mounting clip comprising:

a substantially flat mounting base having first and second opposite ends attached to said external bottom surface of said thermostat cup;

a resilient arm extending from said second end back toward said first end in a spaced relationship with said mounting base, said arm having an end portion spaced apart from said mounting base in a direction perpendicular to said mounting base, and said arm having a tubing receiving portion therein between said second end of said mounting base and said end portion, said tubing receiving portion comprising an arcuate portion; and an opening formed between said mounting base and said arm, said opening being in a direction transverse to said longitudinal axis of said thermostat cup.

2. The thermostat of claim 1 wherein said arcuate portion is defined by a constant radius.

3. The thermostat of claim 2 wherein said constant radius is between 0.125 inch and 1.0 inch.

4. The thermostat of claim 3 wherein said arm has a reversely curved portion adjacent said second end of said mounting base; and a straight portion between said reversely curved portions and said tube receiving portion.

5. The thermostat cup of claim 4 wherein said arm extends from said base at an included angle with said base between 25°–45°.

6. The thermostat of claim 1 wherein said arcuate portion extends over an angle of not less than 90°.

7. The thermostat of claim 6 wherein said arm extends from said base at an included angle with said base between 25°–45°.

8. The thermostat of claim 1 wherein said tubing receiving portion further comprises first and second straight portions, one of said first and second straight portions located tangent to a first end of said arcuate portion and the other of said first and second straight portion located tangent to a second end of said or arcuate portion.

9. The thermostat of claim 8 wherein said arcuate portion extends over an angle of not less than 90°.

10. The thermostat of claim 8 wherein said arcuate portion extends over an angle of about 90° and is tangent to each of said first and second straight portions.

11. The thermostat of claim 8 wherein said arm has an upturned portion adjacent said second end of said base and a straight portion between said upturned portion and said tubing receiving portion.

12. The thermostat of claim 1 wherein said arcuate portion is defined by a constant radius having a center located between said base and said arm, and said center being within 20% of the midpoint between said first and second ends of said base.

13. The thermostat of claim 1 wherein said arm end portion is inclined with respect to said base at an angle that is between 35°–55°.

14. The thermostat of claim 1 wherein said external bottom surface is circular and has a bottom area, and said mounting base of said clip having an area that is at least 40% of said bottom area.

15. The thermostat of claim 1 wherein said external bottom surface is circular and has a bottom diameter, and said mounting base of said clip having a length that is at least 70% of said bottom diameter.

16. The thermostat of claim 1 wherein said external bottom surface is circular and has a bottom diameter, and said mounting base of said clip having a width that is at least 30% of said bottom diameter.

17. The thermostat of claim 1 wherein said arcuate portion extends over an angle of about 90° and is tangent to two straight portions, one adjacent to either side of said arcuate portion.

18. In a thermostat having a longitudinal axis and a bottom wall extending perpendicular to said longitudinal axis, a tube receiving spring clip for attaching said thermostat to a tube, said clip comprising:

a flat mounting base attached to said bottom wall of said thermostat in a heat exchange relationship therewith, said bottom wall having an area and said mounting base engaging said bottom wall over at least 40% of said area;

an integral spring arm spaced outwardly from said base in a direction away from said bottom wall; and a tube opening, said tube opening oriented to receive a tube in a direction substantially perpendicular to-said longitudinal axis.

19. The thermostat of claim 18 wherein said clip further comprises a tube receiving portion for holding a tube substantially centered on said bottom wall.

20. The thermostat of claim 13 wherein said tube opening is located inwardly of an outer periphery of said thermostat.

21. In a thermostat having a longitudinal axis and a wall extending perpendicular to said longitudinal axis, a tube receiving spring clip for attaching said thermostat to a tube, said clip being fixed to said wall of said thermostat in a heat exchange relationship therewith, said clip having a tube opening, said tube opening oriented to receive a tube in a direction substantially perpendicular to said longitudinal axis, said tube opening being between 0.160 inch and 0.260 inch when measured in a direction perpendicular to said wall.

22. The thermostat of claim 21 wherein said clip further comprises a tube receiving portion for holding a tube substantially centered on said wall.

23. The thermostat of claim 21 wherein said tube opening is located inwardly of an outer periphery of said thermostat.

* * * * *

UNITED STATES PATENT AND TRADEMARK OFFICE

CERTIFICATE OF CORRECTION

PATENT NO. : 6,417,758 B1
DATED : July 9, 2002
INVENTOR(S) : Larry Russell et al.

It is certified that error appears in the above-identified patent and that said Letters Patent is hereby corrected as shown below:

Column 7,
Line 8, "locations." should be -- locations --.
Line 19, after "at" insert a second -- -at --.

Column 9,
Line 23, "to-said" should be -- to said --.

Column 10,
Line 4, "13" should be -- 18 --.

Signed and Sealed this

Eighth Day of July, 2003

JAMES E. ROGAN
*Director of the United States Patent and Trademark Office*